US005532095A

United States Patent [19]

Asanae et al.

[11] Patent Number: 5,532,095

[45] Date of Patent: Jul. 2, 1996

[54] MAGNETIC TONER

[75] Inventors: Masumi Asanae, Kumagaya; Masahisa Ochiai, Fukaya; Fumio Kimura, Isezaki; Akihiko Funakawa; Toshihiko Noshiro, both of Kumagaya, all of Japan

[73] Assignee: Hitachi Metals, Ltd., Japan

[21] Appl. No.: 294,968

[22] Filed: Aug. 24, 1994

[30] Foreign Application Priority Data

Aug. 26, 1993 [JP] Japan ..... 5-234153

[51] Int. Cl.[6] ..... G03G 9/083

[52] U.S. Cl. ..... 430/106.6; 430/111; 430/903

[58] Field of Search ..... 430/106.6, 903, 430/111

[56] References Cited

U.S. PATENT DOCUMENTS

| | | | |
|---|---|---|---|
| 4,282,302 | 8/1981 | Makino et al. | 430/106.6 |
| 4,654,287 | 3/1987 | Okuyama et al. | 430/106.6 |
| 5,064,739 | 11/1991 | Asanae et al. | 430/106.6 |
| 5,143,810 | 9/1992 | Nozawa et al. | 430/106.6 |

FOREIGN PATENT DOCUMENTS

| | | | |
|---|---|---|---|
| 0010732 | 5/1980 | European Pat. Off. . | |
| 0487230 | 5/1992 | European Pat. Off. . | |
| 0544288 | 6/1993 | European Pat. Off. | 430/106.6 |
| 55-65406 | 5/1980 | Japan . | |
| 63-46412 | 9/1988 | Japan . | |
| 1-231063 | 9/1989 | Japan | 430/106.6 |
| 4124683 | 4/1992 | Japan . | |

OTHER PUBLICATIONS

Patent & Trademark Office English—Language Translation of Japanese Patent 1–231063 (pub. Sep. 1989).

Communicated dated Dec. 23, 1994, issued by European Patent Office.

English Abstract of Japanese Patent 4–124683 (pub. Apr. 1992).

*Primary Examiner*—Janis L. Dote

*Attorney, Agent, or Firm*—Finnegan, Henderson, Farabow, Garrett & Dunner

[57] ABSTRACT

A magnetic toner includes at least binding resin (for instance, a styrene-acryl resin) and magnetic powder (for instance, Mn—Zn ferrite or Ni—Zn ferrite) having a saturation magnetization of at least 50 emu/g and a coercive force as measured under the magnetic field of 10 kOe not exceeding 50 Oe. An image formed by using this magnetic toner has high quality and is free of tailing.

3 Claims, No Drawings

MAGNETIC TONER

BACKGROUND OF THE INVENTION

1. Field of the Invention

The present invention relates to magnetic toner used in an electrophotographic image formation method.

2. Description of the Prior Art

In many cases, image formation for copiers, printers, etc., employs electrophotography in which a latent electrostatic image is formed on a charged photoreceptor surface, then developed with a developing agent. The photoreceptor surface is charged by a corona discharge, or by a conductive roller or other means, and a latent image is formed by exposure to light emitted from a semiconductor laser, an LED array, or other light sources.

Magnetic brush development is generally employed. A developing agent supplied to a developing roller (consisting of a non-magnetic sleeve and a permanent magnet member incorporated therein) opposed to the photoreceptor surface is conveyed to the developing region by, for instance, rotating the sleeve. An electrostatic latent image is visualized by sliding a magnetic brush formed on the sleeve on the image bearing surface (photoreceptor surface) such that the former frictionally contacts the latter. Then, a toner image is transferred onto, for instance, a plain sheet and fused thereon to become a final image.

Two types of developing agents are known: a two-component developing agent including toner and carrier as main components, and a one-component developing agent including toner as a main component but not carrier. In many cases, each of the two types employs magnetic toner including a binding resin and magnetic powder as main components.

As magnetic characteristics, the magnetic toner must have a large saturation magnetization, particularly, when it is used in the one-component developing agent, because magnetic brush filaments must be high. Further, magnetic toner should have a large coercive force to provide superior developing agent transfer, flow, and cohesiveness. It is desirable that magnetic toner provide a solid black color alone, or with least amounts of coloring agents added.

To satisfy the above magnetic characteristics, the requirement of a solid black color, and other factors, magnetic toners in current use generally include magnetite ($Fe_3O_4$) as a magnetic powder. In general, magnetite for this purpose has a saturation magnetization ($\sigma_s$) of 60–90 emu/g and a coercive force (iHc) of 50–400 Oe.

However, when conventional magnetic toner having the above composition is used as the developing agent alone or with a magnetic carrier, although it can provide a sufficient image density, resolution, etc., black traces may occur due to trailing at the edges of an image, a phenomenon called "tailing." This phenomenon is particularly marked in sleeve rotation development.

SUMMARY OF THE INVENTION

An object of the present invention is to provide magnetic toner for image formation which does not cause tailing but ensures image quality of the same level as conventional magnetic toners.

According to the invention, a magnetic toner is provided for use in electrophotographic image formation, where magnetic toner includes at least binding resin and magnetic powder having a saturation magnetization of at least 50 emu/g and a coercive force, as measured under a magnetic field of 10 kOe, not exceeding 50 Oe.

The magnetic powder is a soft ferrite powder having a composition represented by a general formula, $(MO)_{100-x}(Fe_2O_3)_x$, where x is 45 to 70 mol % and MO includes an oxide of Zn and an oxide of at least one element selected from among Li, Mn, Ni, Mg, Cu, etc.

If the coercive force as measured under the magnetic field of 10 kOe exceeds 50 Oe, tailing may occur. The tailing mechanism remains to be completely clarified, but the present inventors presume that it occurs as follows:

Tailing occurs when a toner image is produced by development and tails extend from it. Toner particles that have moved onto a photoreceptor surface at the back of an image in development are believed to be attracted by a magnet roller or magnetic brush and to stick to portions that should not contribute to formation of a printed image. If magnetic toner powder has a large coercive force, the attractive magnetic force between toner particles on the image and the magnet roller is strong and would cause tailing. If the coercive force is small, the attractive magnetic force is weak and would be less likely cause tailing.

Thus, it is understood that, to prevent tailing, magnetic powder should have a smaller coercive force. Tailing can be prevented effectively by using magnetic powder having a coercive force preferably less than 10 Oe or, more preferably, 0.

Magnetic material having the desired coercive force can be obtained by selecting a proper structure from the magnet plumbite structure, spinel structure, etc., selecting proper additives, or adjusting the magnetic orientation characteristic.

A pulverized powder of a soft ferrite can be used as a magnetic powder having a small coercive force. Soft ferrites usable for this purpose include Li—Zn ferrite, Mn—Zn ferrite, Ni—Zn ferrite, Mg—Zn ferrite, Cu—Zn ferrite, etc. These ferrites preferably have an average particle diameter not exceeding 1 μm to enable them to be dispersed in toner. The content of soft ferrite in magnetic toner is preferably 20 to 70 wt % of the toner. If the content is less, toner is likely to scatter. If the content exceeds 70 wt %, fusing is insufficient.

The magnetic toner of the invention may include, in addition to the aforementioned main components, additives such as coloring agents, flow improvement agents (hydrophobic silica, alumina, etc.), charge control agents (nigrosine dye, metal-inclusive azo dye, etc.), and mold release agents (polypropylene, polyethylene, etc.). To ensure sufficient fusing, the total content of the above additives is preferably no more than 15 wt %.

The magnetic toner of the invention can be produced by a known method (pulverization, spray-drying, etc.) using the above materials.

To obtain satisfactory image quality, magnetic toner preferably has a volume average particle diameter of 5–15 μm, a volume resistivity of $10^{13}$ Ω.cm or more, and a triboelectricity in an absolute value of 5–60 μC/g.

The volume resistivity is measured such that a cylinder of Teflon (trade name) and having an inner diameter of 3.05 mm is charged with a sample of 10 plus several milligrams and measurement is made with an electric field of 4 kV/cm under 0.1 kg loading. The particle diameter is measured with a particle analyzer (Colter Electronics counter model TA-II, manufactured by Colter Electronics, Inc. The triboelectricity is measured by mixing a standard carrier (KBN-100, manufactured by Hitachi Metals, Ltd.) with magnetic toner (toner density: 5 wt %) and using a blowoff triboelectricity meter (Model TB-200 manufactured by Toshiba Chemical Corp.).

DESCRIPTION OF THE PREFERRED EMBODIMENTS

Embodiment 1

To provide a magnetic toner of this embodiment, 56 parts by weight of a styrene-acryl resin (TBH2500, manufactured by Sanyo Chemical Industries, Ltd.) was used as a binding resin, 40 parts by weight of a pulverized Mn—Zn ferrite powder (average particle diameter: 1.0 μm, saturation magnetization: 84 emu/g, coercive force under a 10-kOe magnetic field: 0.10 Oe) as a magnetic powder, 2 parts by weight of polypropylene (Viscose 660P, manufactured by Sanyo Chemical Industries, Ltd.), 1 part by weight of carbon black (#44, manufactured by Mitsubishi Kasei Corp.), and 1 part by weight of a charge control agent (BONTRON S-34, manufactured by Orient Chemical Industries, Ltd.).

The above components were to dry-blended, then kneaded during heating and cooled to solidify. The mixture was the pulverized and classified. Thus, toner particles were obtained. Thereafter, 0.5 parts by weight of hydrophobic silica (R972, manufactured by Nippon Aerosil Co., Ltd.) was added to 100 parts by weight of the toner particles thus formed to obtain magnetic toner having a volume average particle diameter of 10 μm, a resistivity of $10^{14}$ Ω.cm, and a blowoff triboelectricity of −18 μC/g.

The aforementioned pulverized Mn—Zn ferrite powder was prepared as magnetic powder as follows:

First, $MnCO_3$ of 30 mol %, ZnO of 18 mol %, and $Fe_2O_3$ of 52 mol % were mixed for 15 hours in a dry ball mill. The slurry was granulated by a spray dryer, then sintered at 1,300° C. for 2 hours in a nitrogen atmosphere and, after sintering, cooled to room temperature. The sintered material was then pulverized with a stamp mill and an atomizer. The slurry obtained from the pulverized powder was again pulverized with a wet attrition mill, then dried. The dried material was crushed to obtain magnetic powder having an average particle diameter of 1.0 μm.

Metal carbonates, chlorides, oxalates, etc., may be used as starting materials of ferrite.

In the above manner, pulverized Mn—Zn ferrite powder having such magnetic characteristics as saturation magnetization of 84 emu/g and coercive force under a 10-kOe magnetic field of 0.1 Oe was prepared. The coercive force was measured with a vibration sample magnetometer (Model VSM-3, manufactured by Toei Industry Co., Ltd.) under a maximum magnetic field of 10 kOe.

Further, a two-component developing agent was prepared by mixing the above magnetic toner (toner density: 30 wt %) with a ferrite carrier (KBN-100, manufactured by Hitachi Metals, Ltd.; particle diameter: 37–105 μm). An image formation experiment was made with an inversion development printer using the two-component developing agent thus prepared, in which tailing in images was checked. Results are given later.

Toner density in the developing agent is preferably 10–90 wt %, more preferably 10–50%, and most preferably 15–30%.

Embodiment 2

In the second embodiment, magnetic toner was prepared as follows in which pulverized Mn—Zn ferrite powder of the first embodiment was replaced with a pulverized Ni—Zn ferrite powder; other components and the composition ratio were kept the same.

That is, used 56 parts by weight of a styrene-acryl resin (TBH2500, manufactured by Sanyo Chemical Industries, Ltd.) was used as a binding resin, 40 parts by weight of a pulverized Ni—Zn ferrite powder (average particle diameter: 0.50 μm, saturation magnetization: 76 emu/g, coercive force under a 10-kOe magnetic field: 0.10 Oe) as a magnetic powder, 2 parts by weight of polypropylene (Viscose 660P, manufactured by Sanyo Chemical Industries, Ltd.), 1 part by weight of carbon black (#44, manufactured by Mitsubishi Kasei Corp.), and 1 part by weight of a charging control agent (BONTRON S-34 manufactured by Orient Chemical Industries, Ltd.).

The above components were dry-blended, then kneaded during heating and cooled to solidify. The mixture was then pulverized and classified. Thereafter, 0.5 parts by weight of hydrophobic silica (R972, manufactured by Nippon Aerosil Co., Ltd.) was added to 100 parts by weight of the magnetic toner thus formed.

Preparation of the pulverized Ni—Zn ferrite powder and measurement of its magnetic characteristics were performed the same as in the first embodiment. The magnetic toner was mixed with a ferrite carrier the same as in the first embodiment to provide a two-component developing agent, subjected to an image formation experiment to check for tailing.

Further, to compare the effectiveness of the first and second embodiments with conventional toners, magnetic toners for reference were prepared as follows and subjected to an image formation experiment similar to those for the above embodiments.

In a first reference example, commercial magnetite, i.e., KBC-100 (manufactured by Kanto Denka Kogyo Co., Ltd.; saturation magnetization: 88 emu/g, coercive force under a 10 kOe magnetic field: 80 Oe) was used as magnetic powder. In a second reference example, commercial magnetite, i.e., EPT-500 (manufactured by Toda Kogyo Corp.; saturation magnetization: 83 emu/g, coercive force under a 10 kOe magnetic field: 122 Oe) was used as magnetic powder. In each of the first and second reference examples, magnetic powder of the first embodiment was replaced with the aforementioned KBC-100 or EPT-500 but other components and the composition ratio were kept the same as in the first embodiment. Two-component developing agents were prepared the same as in the first embodiment using magnetic toners thus formed, and subjected to image formation experiments to check for tailing.

Image formation experiments were performed on the first and second embodiments and the first and second reference examples under the same image formation conditions as below. Table 1 gives image evaluation results.

Image formation conditions were as follows: Inverse development was done under the following conditions: A negatively charged OPC drum (surface potential: −550 V) was rotated at a circumferential speed of 60 m/s. A developing sleeve was made of SUS304 and had a diameter of 20 mm. The internal magnet used 6-pole magnetization. The sleeve rotated at 200 rpm. The magnetic field on the sleeve was 700 G. The bias voltage applied to the sleeve was set at −470 V. The developing gap was set at 0.35 mm and the doctor blade gap at 0.25 mm. After the developed toner image was corona-transferred to a plain sheet, heated roller fusing was performed with the surface temperature of the heated roller being 190° C. and the interroller linear load being 1 kg/cm.

TABLE 1

| | Tailing occurance | Image density | Resolution (Lines/mm) | Magnetic characteristics under 10-kOe magnetic field | |
|---|---|---|---|---|---|
| | | | | Saturation magnetization (emu/g) | Coercive force (Oe) |
| Embodiment 1 | No | 1.3 | 12 | 84 | 0.1 |
| Embodiment 2 | No | 1.3 | 12 | 76 | 0.1 |
| Reference example 1 | Yes | 1.3 | 8 | 88 | 80 |
| Reference example 2 | Yes | 1.3 | 8 | 83 | 122 |

Table 1 shows that the magnetic toner of the first and second embodiments prevented tailing and provided improved resolution compared to conventional magnetic toners of the first and second reference examples while maintaining the same image density.

Further, while dust was found on images in the first and second reference examples, no dust was found in the embodiments.

Although the above embodiments are directed to the two-component developing agent in which magnetic toner is mixed with ferrite carrier, the invention can also be applied to a one-component developing agent including only magnetic toner.

Although, in the above embodiments, a styrene-acryl resin is used as the binding agent, other known resins for a toner, for instance, synthetic resins such as polyester resin and epoxy resin can also be used for this purpose.

As described above, by using magnetic toner according to the invention, image tailing can be prevented while image density, resolution, and other characteristics are kept the same as in conventional cases.

As a result, unlike conventional cases, no traces occur from tailing. Therefore, in particular, it has become possible to improve quality in a high-resolution image.

What is claimed is:

1. A magnetic toner including at least a binding resin and a magnetic powder having a saturation magnetization of 50 emu/g or more and a coercive force of 0.1 Oe or less as measured under a magnetic field of 10 kOe, wherein the magnetic powder is a soft ferrite powder having a composition represented by a general formula, $(MO)_{100-x}(Fe_2O_3)_x$, where x is 45 to 70 mol % and MO includes an oxide of Zn and an oxide of at least one element selected from the group consisting of Li, Mn, Ni, Mg, and Cu.

2. The magnetic toner according to claim 1, wherein content of the soft ferrite powder in the magnetic toner is 20 to 70 wt %, of the toner.

3. The magnetic toner according to claim 1, wherein the magnetic toner has a volume average particle diameter of 5–15 μm, a volume resistivity of $10^{13}$ Ωcm or more, and a triboelectricity in an absolute value of 5–60 μC/g.

* * * * *